US005819644A

United States Patent [19]

Coffelt

[11] Patent Number: 5,819,644

[45] Date of Patent: Oct. 13, 1998

[54] AUTOMATIC CAN SMASHER

[76] Inventor: Mark A. Coffelt, P.O. Box 81, Clarksburg, Mo. 65025

[21] Appl. No.: 768,640

[22] Filed: Dec. 18, 1996

[51] Int. Cl.[6] ..... B30B 9/32

[52] U.S. Cl. ..... 100/49; 100/53; 100/216; 100/283; 100/902

[58] Field of Search ..... 100/45, 49, 53, 100/216, 283, 902

[56] References Cited

U.S. PATENT DOCUMENTS

| | | | |
|---|---|---|---|
| 3,709,440 | 1/1973 | Kontz | 100/49 |
| 3,916,780 | 11/1975 | Heiser | 100/49 |
| 4,108,065 | 8/1978 | Unger | 100/49 |
| 4,358,994 | 11/1982 | Talley | 100/49 |
| 4,474,108 | 10/1984 | Lonze | 100/45 |
| 4,771,685 | 9/1988 | Wagner . | |
| 5,121,685 | 6/1992 | Turner | 100/49 |

*Primary Examiner*—Stephen F. Gerrity

*Attorney, Agent, or Firm*—Richard Grundstrom

[57] ABSTRACT

An automatic can smasher having a frame assembly with a pair of parallel channel members in a spaced relationship for receiving a can to be smashed. A motor is attached to the underside of the frame assembly. The motor drives a plunger arm assembly having a reciprocating plunger that compresses and smashes the can. A switch mounted on a switch mounting plate is operated when a can is placed within the frame assembly. The switch activates the motor and the reciprocating plunger. A hole through the frame assembly in front of the switch mounting plate allows the smashed can to fall through the frame assembly. A can receptacle can be placed over the frame assembly for placement of a plurality of cans and for feeding the cans one at a time into the frame assembly. When the plunger is retracted, one smashed can drops through the hole in the frame assembly, the switch is released and opened and the next can is allowed to fall into place for being smashed. A can collection receptacle can also be mounted under the opening in the frame assembly for the collection of the smashed cans.

14 Claims, 8 Drawing Sheets

AUTOMATIC CAN SMASHER

BACKGROUND OF THE INVENTION

The present invention relates to a automatic can smasher and more particularly to a automatic can smasher having a pair of parallel channels forming a can receiving area, a reciprocating plunger for smashing a can, and a switch that automatically initiates the operation when a can is placed in the can receiving area.

Aluminum is a metal that has many uses. Aluminum cans for beverages is one example, and this invention pertains to the recycling of these aluminum cans. Since a high percentage of aluminum being manufactured today is from recycled aluminum, it is beneficial to collect and recycle the aluminum from cans.

Aluminum cans are hollow cylinders with closed ends. When empty they occupy a large unused volume. Once empty, the cans can be crushed to reduce the volume needed for storage and transportation during the recycling process. There are many can smashers available on the market and known in the art. There are manual operated smashers and there are mechanical smashers. This invention is an automatic can smasher electrically operated.

The manual can smashers typically have a lever operated smashing device. The smashing device is usually a piston or a plate operating in conjunction with a fixed plate. The can is compressed or smashed between the fixed plate and the piston or plate operated by the lever.

There are also electrically operated can smashers as described in U.S. Pat. No. 4,771,685. These typically have a reciprocating piston that smashes or compresses a can. The unit described in the mentioned patent has a gear assembly and several moving parts. It is activated by a manually operated electric switch. Typically, these units are also designed to fit on top of a waste container. Since there are many moving parts the life expectancy is low and there will be problems associated with the interaction of all the parts. The cost of manufacturing such an assembly is typically high due to the number of parts. In addition, operation is not automatic. The unit has to be manually started by an electrical switch.

The present invention is automatically operated and has few moving parts. It can be attached under a counter making it very convenient or in other locations. Since there are few moving parts, reliability is high and production costs are reduced.

Accordingly, it is an object of the present invention to provide an automatic can smasher that has few moving parts. The automatic can smasher of this invention only has three moving parts that operate in unison, eliminating all the gearing of other can smashers known in the art.

Another object of the present invention is to provide an improved automatic can smasher that is operated automatically any time a can is placed within the device. This feature makes the unit very easy to operate and eliminates the need for additional operations by an individual putting a can in the unit to be smashed.

A further object of the present invention is to provide an automatic can smasher that is adapted for installation in several different locations. The present invention can be placed under a counter top, or any other flat horizontal surface, such as a table, or it can be mounted over a trash receptacle.

Still another object of the present invention is to provide a automatic can smasher that may be manufactured at a low cost making it affordable for the consumer.

Still a further object of the present invention is to provide an automatic can smasher that has a simple operation making it jam proof and easy to repair, if needed. The automatic can smasher of this invention is characterized by simple components assembled for easy repair yet designed for a long service life.

SUMMARY OF THE INVENTION

To accomplish the foregoing and other objects of this invention there is provided a automatic can smasher.

The automatic can smasher of this invention includes a frame assembly, the frame assembly having a pair of parallel channel members in a spaced relationship for receiving a can. A motor attaches to a first end of the frame assembly and a switch mounting plate attaches to the other end. The motor drives a reciprocating plunger to smash a can. A hole through the frame assembly in front of the switch mounting plate allows a smashed can to fall from the frame assembly. A can placed on the frame assembly operates a switch attached to the switch mounting plate. The switch activates the motor. The motor by the way of a rotating lever operates the plunger in a reciprocating motion. The plunger smashes the can against the switch mounting plate. When smashed the can drops through the hole allowing the next can to fall into place when the plunger retracts.

These and other objects and features of the present invention will be better understood and appreciated from the following detailed description of the main embodiment thereof, selected for purposes of illustration and shown in the accompanying drawings.

DETAILED DESCRIPTION

Figure 1:
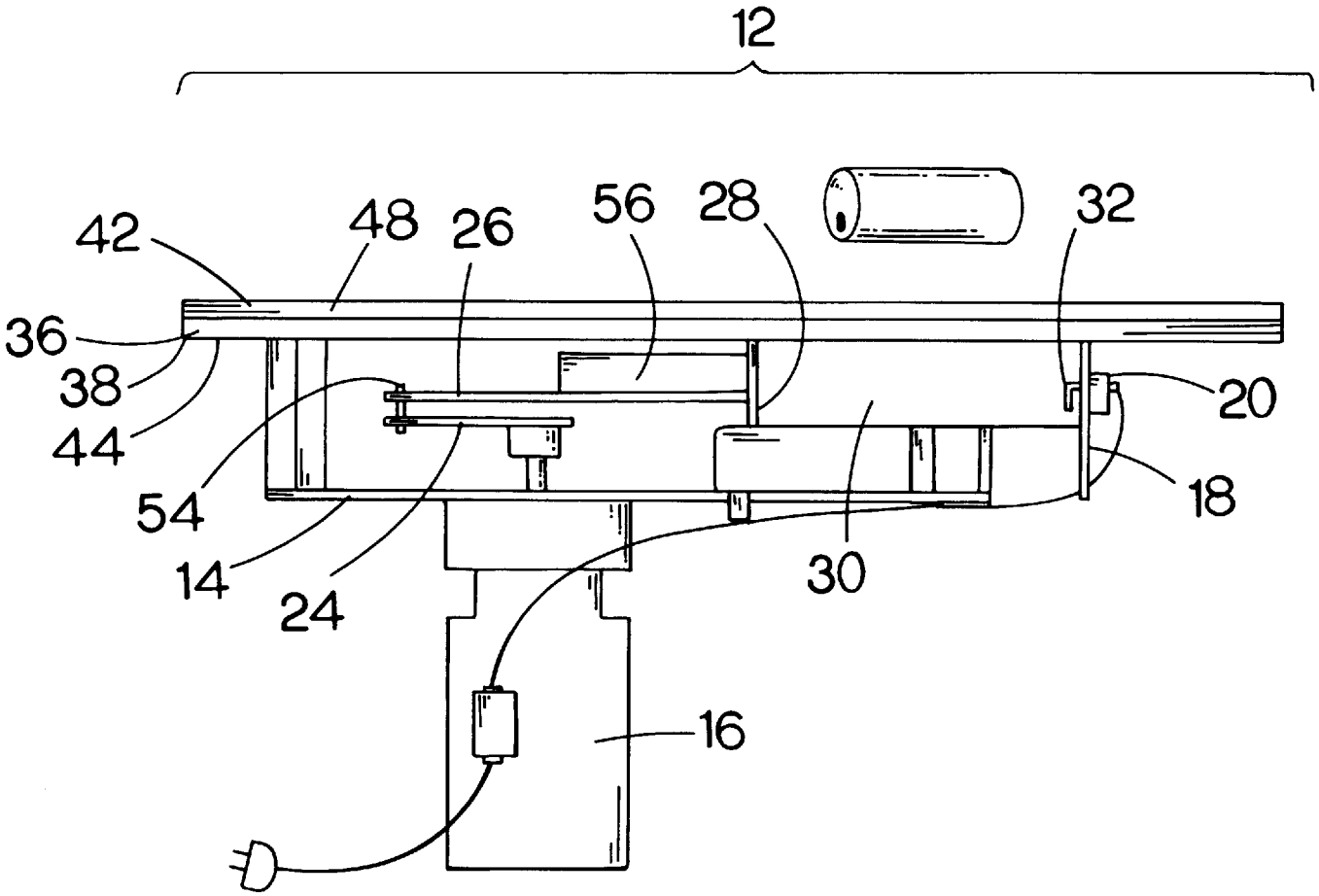
FIG. 1 is a side elevation view of the automatic can smasher.
Figure 2:
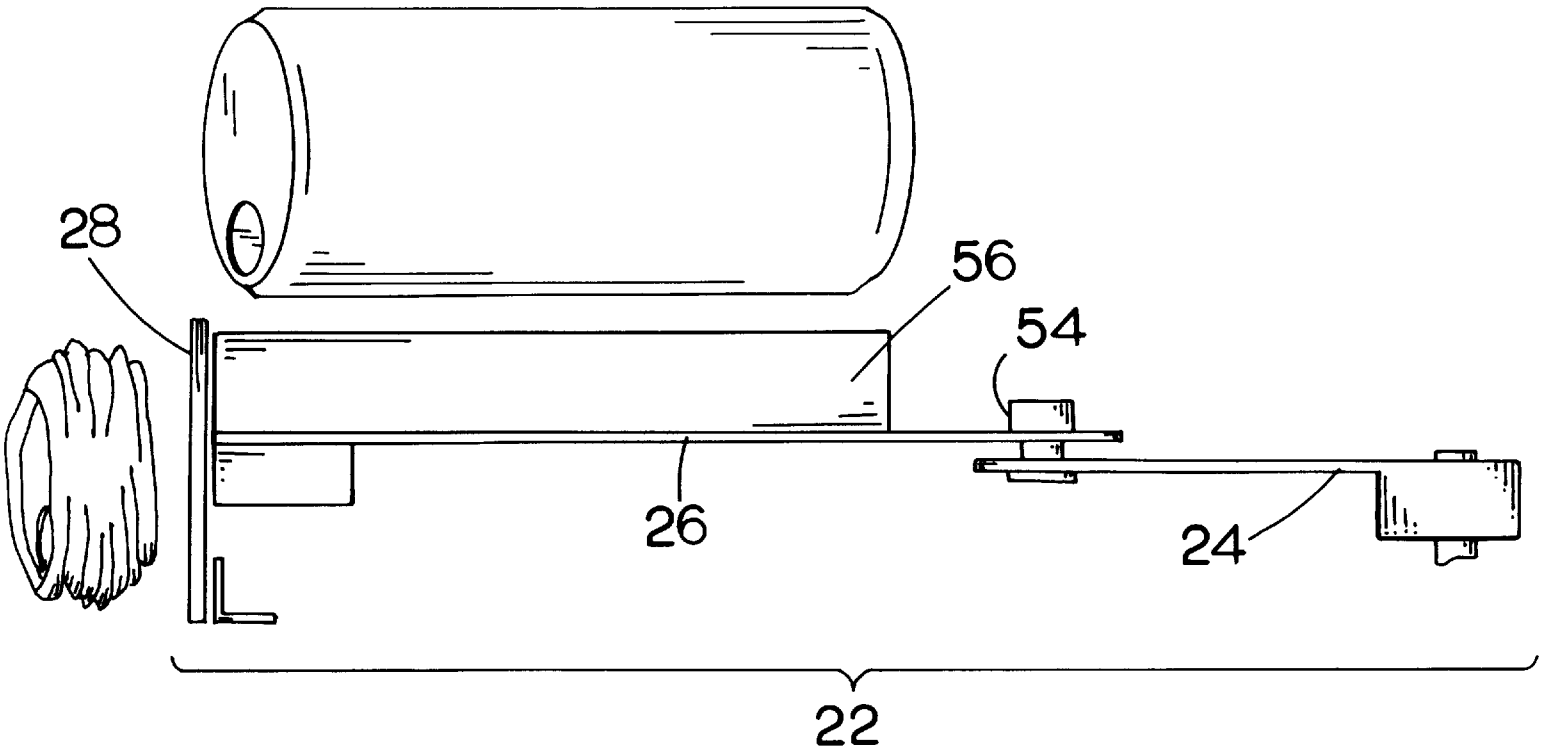
FIG. 2 is a side elevation of the plunger arm assembly.
Figure 3:
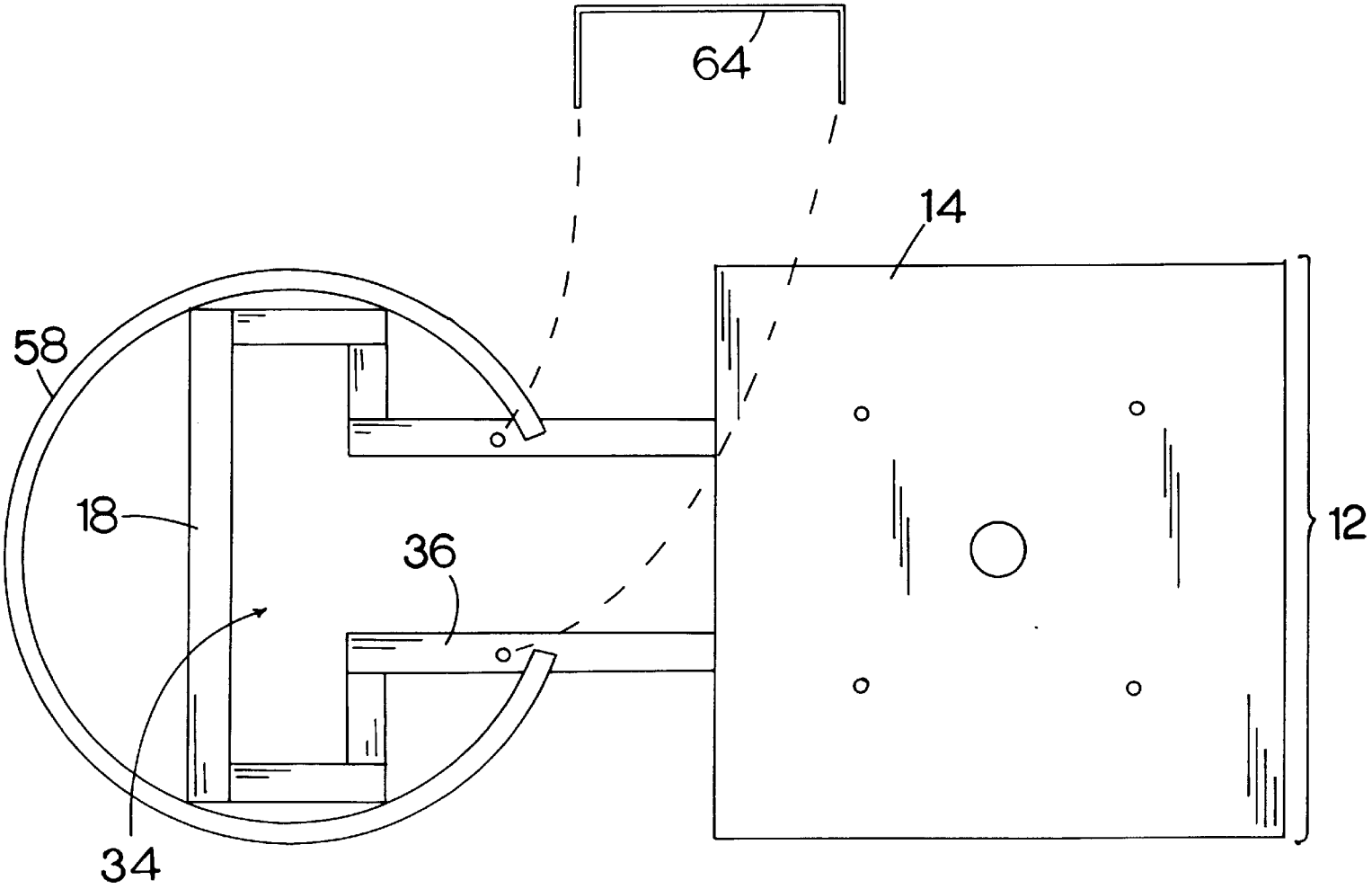
FIG. 3 is a bottom view of the frame assembly showing the bag ring and motor mount.
Figure 4:
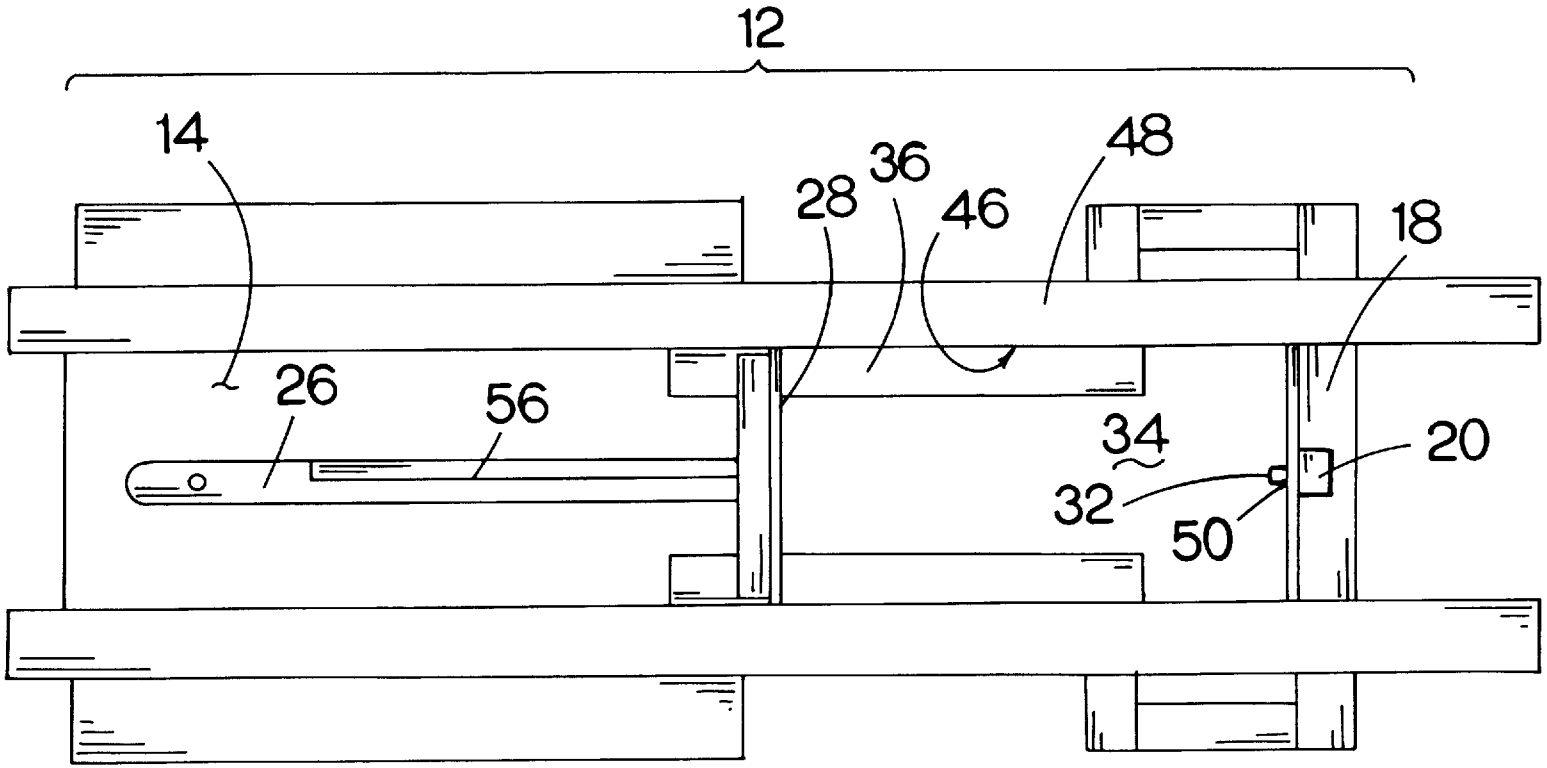
FIG. 4 is a top view of the frame assembly.
Figure 5:
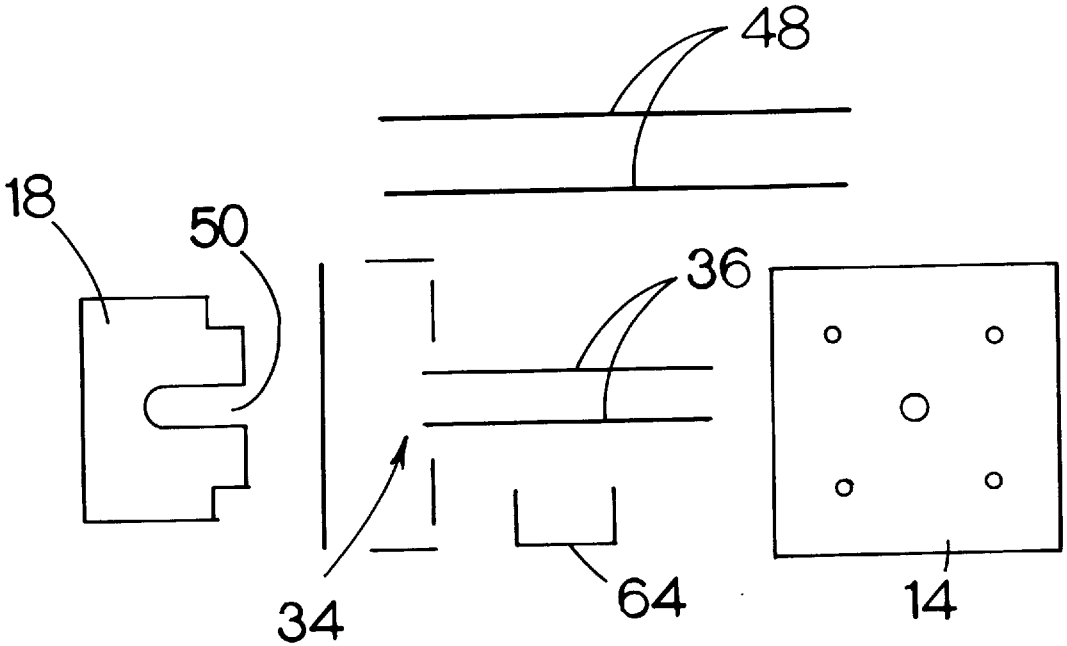
FIG. 5 is a schematic exploded view representation of the frame assembly.
Figure 6:
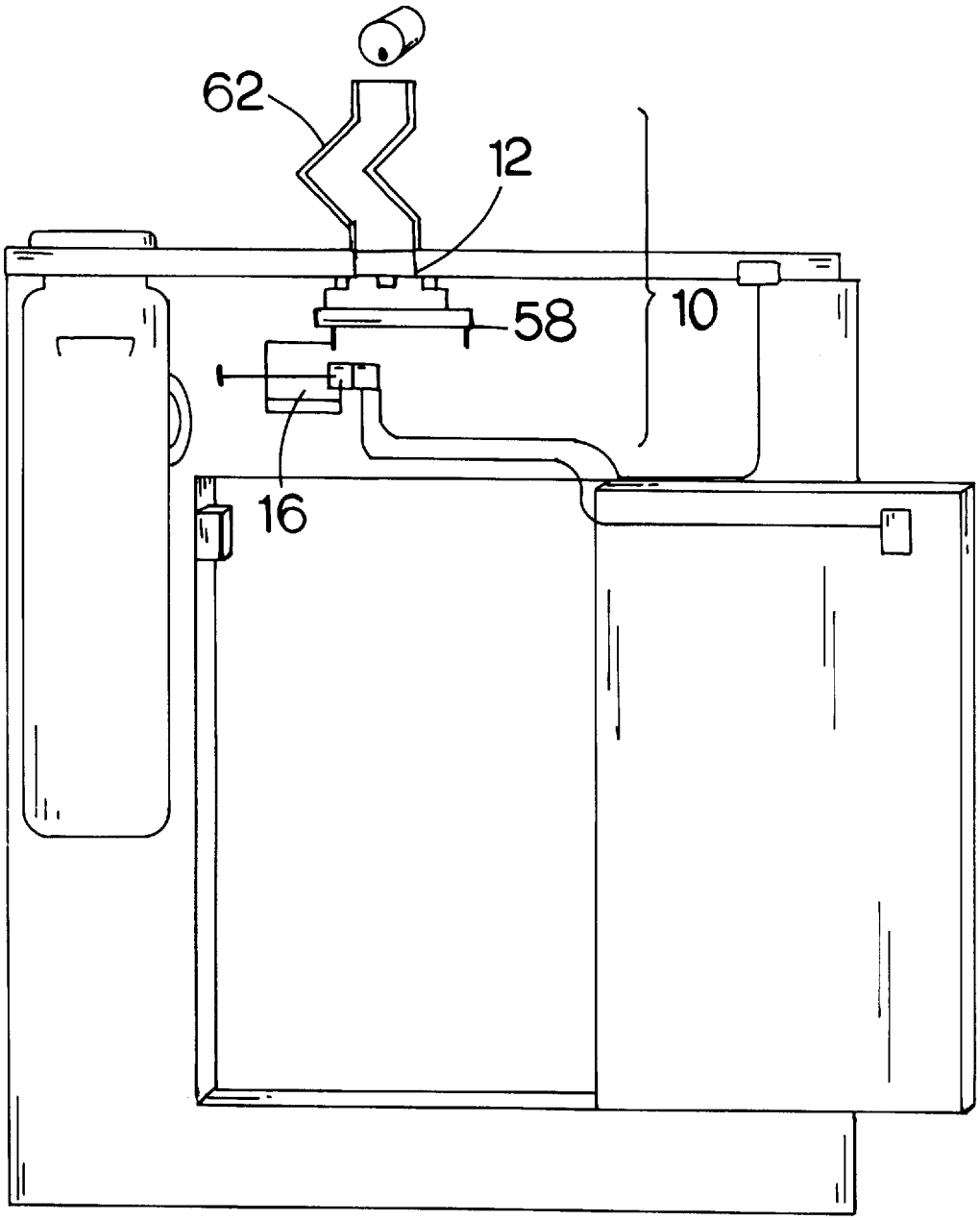
FIG. 6 is a view showing the automatic can smasher installed within a cabinet and showing the safety wiring harness.
Figure 8:
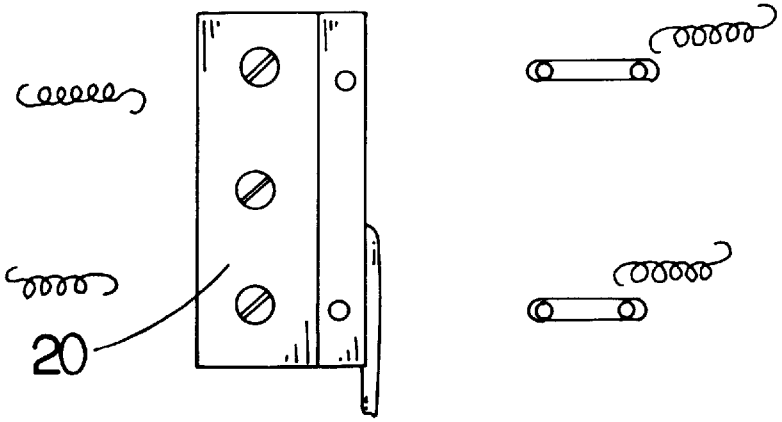
FIG. 8 is a view of the switch mounting plate with the switch attached.
Figure 7:
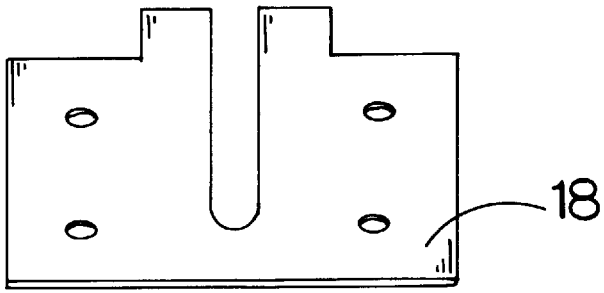
FIG. 7 is a view of the switch mounting plate.
Figures 9, 10:
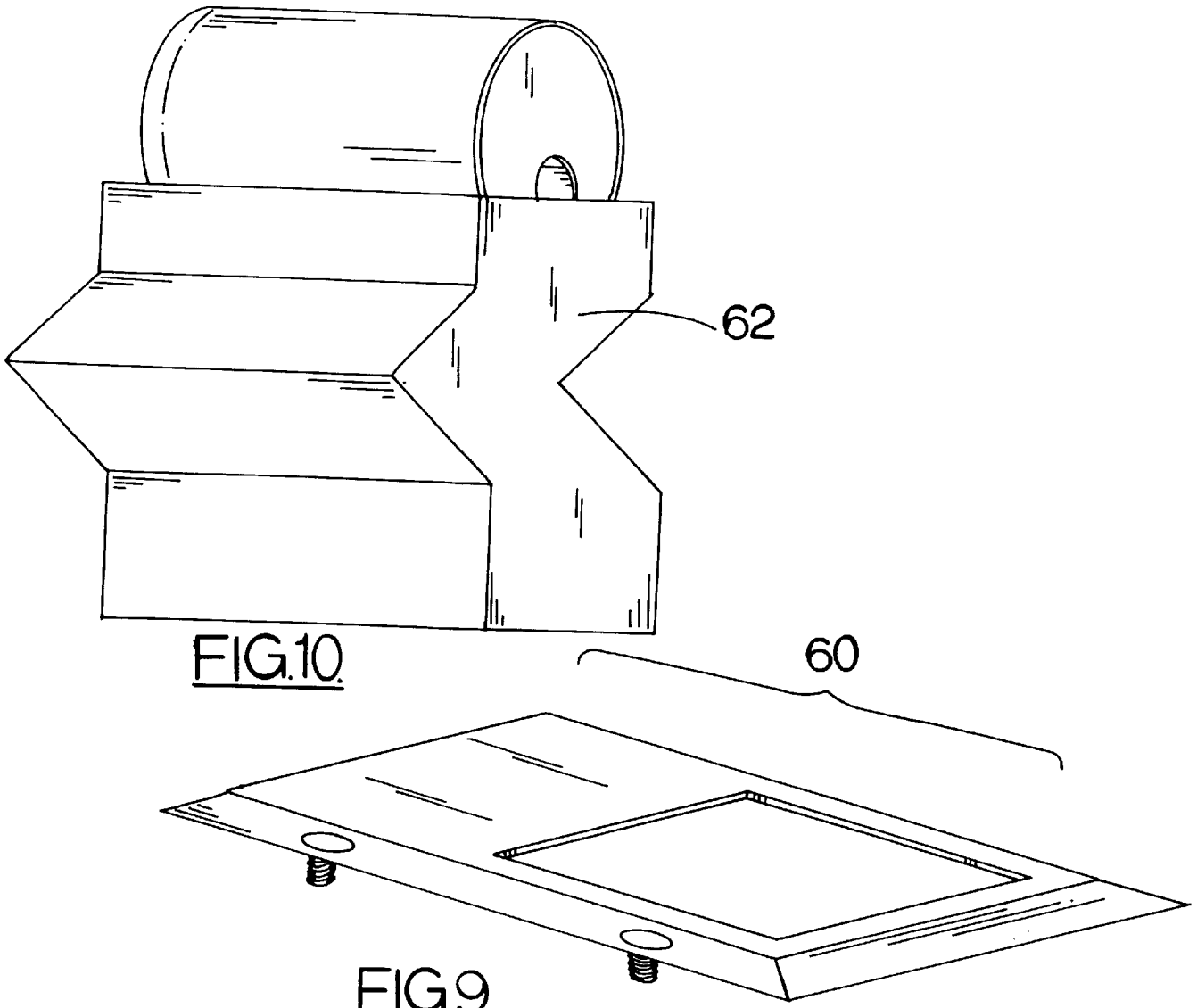
FIG. 9 shows the lid for a table or counter top mounting.
FIG. 10 shows the can receiving receptacle.

Referring now to the drawings in general there is shown the preferred embodiment for the automatic can smasher of this invention.

The automatic can smasher 10 generally has in the preferred embodiment a frame assembly 12, a motor mount 14, a motor 16, a switch mounting plate 18, a switch 20, a plunger arm assembly 22 having a rotatable arm 24, a reciprocating arm 26 and a plunger plate 28. These components operate in unison to automatically compress or smash a can when a can is placed or allowed to fall within a can receiving area 30 in the frame assembly 12.

A basic description of the operation will assist in the understanding of the various components described hereinafter and their interaction. A can is placed or allowed to fall into a can receiving area 30 on the frame assembly 12. The can operates a lever 32 on the switch 20. The switch 20 closes a circuit to activate the motor 16. The plunger arm assembly 22 operating in a reciprocating action compresses or smashes the can against the switch mounting plate 18. As the pressure of the plunger plate 28 against the can is relieved, due to the reciprocating action of the plunger arm assembly 22, the smashed can falls through an opening 34 on the frame assembly 12. When the can falls through the opening 34, the lever 32 on switch 20 is released and the circuit to the motor 16 is opened. The motor 16 used in the preferred embodiment will return to a preset position. This will leave the plunger assembly 22 in a retracted position and leave the can receiving area 30 open for receipt of another can. When another can is placed or allowed to fall within the can receiving area 30 the cycle is repeated.

The preferred embodiment and the best mode contemplated of the automatic can smasher of the present invention are herein described. However, it should be understood that the best mode for carrying out the invention hereinafter described is offered by way of illustration and not by the way of limitation. It is intended that the scope of the invention include all modifications which incorporate its principal design features. Another motor or plunger arm assembly could be used that is not specifically described herein. As long as the "motor" provides the reciprocating action or rotational movement, with a minimum number of moving parts, to cause the reciprocating action as described herein, the intent will be met.

The frame assembly 12 has a pair of channels 36 that define the bottom and sides of the can receiving area 30. The frame assembly 12 may also have upper channels 48 located immediately above channels 36. As indicated above the can receiving area 30 receives and supports the can to be smashed. The channels 36 are held and secured in a parallel spaced relationship. The channels 36 will be spaced far enough apart to support the can and prevent the can from falling through. The channels 36 will typically have a first end 38, second end 40, top 42 and bottom 44.

The upper channels 48 provide an upward extension for the channels 36 and further define the dept of the can receiving area 30. Upper channels 48 will typically be longer then channels 36 to provide structural support for the frame assembly and for providing a means of attachment to an underside of a table or counter.

In the preferred embodiment, channels 36 of frame assembly 12 are made with two pieces of one and one eight inch angle iron six inches long. Similar type of channel material could also be used. One leg of each of the angle iron pieces face inward to form the bottom 44 of the can receiving area 30. The second leg of the angle iron pieces extend upwards to define sides 46 of the can receiving area. The opening 34 on frame assembly 12, that the smashed cans fall through, is made at the end of the inward facing legs or on the bottom 44 of the channels 36 near the switch mounting plate 18.

The upper channels 48 can also be made with angle iron or by any other suitable type material. In the embodiment as shown, the upper channels 48 are one and a half inch angle iron pieces twenty and a half inches long.

A motor mount 14 is attached to a bottom of the frame assembly 12 near the first end 38 of the channels 36. The motor mount 14 is a bracket for attaching motor 16 to the frame assembly 12. In the embodiment as shown, the motor mount 14 is a piece of flat plate steel having holes bored therethrough for attaching the motor 16 with bolts. The motor mount 14 also secures and holds the first end 38 of the channels 36 of the frame assembly 12 in a parallel spaced relationship. The motor mount 14 can be welded to channels 36, bolted or can be attached in other way now known or yet to be developed. Welding is the preferred embodiment because of no further maintenance required and for reliability, but other ways of attaching the mounter mount 14 to the frame assembly 12 will also meet the intent. Brackets will extend upward from channels 36 near the motor mount 14 for securing the ends of upper channels 48 in a parallel spaced relationship.

The end opposite the motor mount 14 of the channels 36 of the frame assembly 12, is a switch mounting plate 18. The switch mounting plate 18 is attached to the second end 40 and secures and holds the second end 40 of the channels 36 in a parallel spaced relationship. The upper channels 48 will also be attached to the switch mounting plate 18. The switch mounting plate 18 also defines one end of the can receiving area 30. In the preferred embodiment, the switch mounting plate 18 is a rectangular piece of plate steel. The dimensions of the embodiment as shown is two and one eighth by four inches. However, other dimensions would also work. Again it can be welded or attached in any other way now or later known in the art. Welding is currently the preferred embodiment for the same reason as welding the motor mount 14.

The opening 34 through channels 36 in the frame assembly 12 is made right in front of the switch mounting plate 18 and within the can receiving area 30. The opening 34 allows a can to drop through the frame assembly 12 after being compressed or smashed. The opening will typically be a rectangular opening slightly larger than the dimensions of the smashed can. In the preferred embodiment, the dimensions of the opening 34 are one and a half inches by four inches. The opening can be made by cutting the opening 34 through the bottom of channels 36 or it can be made by separate pieces attached to the channels 36.

A switch 20 is attached to the outside of the switch mounting plate 18. The lever 32 of the switch 20 extends through an aperture 50 on the switch mounting plate 18 and extends over the opening 34 in the frame assembly 12. The lever 32 is operated by a can inserted into the can receiving area 30. In the preferred embodiment, the switch 20 is a micro switch. The lever 32 of the micro switch 20 extending through the aperture 50 on the switch mounting plate 18. The preference is a micro switch because of the limited force and movement needed to operate the switch.

The motor 16 is attached to the motor mount 14, typically using bolts. The shaft of the motor 16 extends upwards between channels 36 of the frame assembly 12. The motor 16 is activated by switch 20 when a can is positioned in the can receiving area 30. In the preferred embodiment, the motor 16 is an electric split phase gear motor. This removes the necessity of having a number of gears needed in producing a reciprocating action and simplifies electrically wiring the automatic can smasher 10 of this invention.

A rotatable arm 52 is securely attached to the shaft of the motor 16. The rotatable arm 52 will have a first end that is attached to the shaft of the motor 16. A pivot pin 54 is attached to the second end of the rotatable arm 52. Rotatable arm 52 will rotate in conjunction with the shaft of motor 16. As the shaft of the motor 16 rotates so will the rotatable arm 52. The rotatable arm 52 is positioned and rotates between the channels 36.

A reciprocating arm 26 is rotatably attached to the pivot pin 54. In this set up, the reciprocating arm 26 can free rotate about the pivot pin 54 if allowed to do so. The reciprocating pin 54 has a first end that is attached to the pivot pin 54 on the rotating lever. A second end extends forward towards the switch mounting plate 18. As the rotatable arm 24 rotates, the second end end of the reciprocating arm is held in a position midway between the channels 36. The second end of the reciprocating arm 26 slides forward and backwards as it pivots around the pivot pin 54. This creates a reciprocating action.

A plunger plate 28 is attached to the second end of the reciprocating arm 26. The plunger plate 28 defines an end of the can receiving area 30 opposite of the switch mounting plate 18. The plunger plate 28 operates in a reciprocating movement along channels 36 of the frame assembly 12 due to the reciprocating action of the reciprocating arm 26. The plunger plate 28 operates to compress and smash a can against the switch mounting plate 18. As the plunger plate 28 is retracted from the smashed can, due to the reciprocating action, the can falls through the opening 34 clearing the can receiving area 30 for another can. In the preferred embodiment, the plunger plate 28 is a piece of plate steel two and three quarters inches by 2 inches.

The rotatable arm 24, reciprocating arm 26 and the plunger plate 28 are grouped together as a plunger arm assembly 22. The components of the plunger arm assembly 22 are the only moving parts within the automatic can smasher 10, except for the shaft rotating in motor 16. It has been demonstrated that there is a higher degree of reliability with fewer moving parts and with more simple interaction of various components. The parts of the plunger arm assembly 22 are all very simple and have a high degree of reliability.

To prevent jamming of the plunger arm assembly 22 by another can, a next can slide bar 56 is attached to the reciprocating arm 26. The next can slide bar 56 closes off the can receiving area 30 as the plunger arm assembly 22 slides forward and the plunger plate 28 operates to smash a can. The next can slide bar 56 prevents another can from falling into the can receiving area 30 and jamming the reciprocating action of the plunger arm assembly 22. In the preferred embodiment, the next can slide bar 56 is a piece of bar steel attached perpendicularly to the top surface of the reciprocating arm 26.

Several other options are available on the automatic can smasher, depending on the particular application. A bag ring 58 can be attached to the underside of channels 36 under the opening 34. Typically, a plastic trash bag would be attached to the bag ring 58 for the collection of the smashed cans. The bag ring 58, as shown on the embodiment illustrated, is a one inch steel ring having a five inch diameter.

A bar 64 attaches to the underside of channels 36 to prevent dented cans from falling through the channels 36. The bar 64 closes any openings through the channels 36. Therefore, cans placed within the can receiving area 30 have to be compressed or smashed and exit by falling through opening 34. Typically, bar 64 is a short piece of channel iron fitted as necessary to close any unnecessary opening through channels 36.

A table top assembly can be used when attached to the underside of a table or counter. The table top assembly would consist of an opening through the table or counter top, a slide lid 60 to cover the opening, and a series of screws or bolts for attaching the automatic can smasher 10 under a table top or counter. The opening would have to be slightly larger than the can receiving area 30. The automatic can smasher 10 would be attached by screws extending through the upper channels 48 into the underside of the table top or counter, with the can receiving area 30 positioned under the opening. The slide door 60 would be positioned over the opening so the opening could be closed off when not in use and to provide a finished appearance.

A can receiving receptacle 62 can be attached to the frame assembly 12 over the can receiving area 30. The can receiving receptacle 62 receives a plurality of cans and feeds one can after another into the automatic can smasher 10. As a can is dropped by gravity into the can receiving area, the switch lever 32 is operated to activate the motor. The plunger assembly 22 smashes the can. The next can slide bar 56 prevents the next can from falling into the can receiving area. As the reciprocating arm 26 retracts the smashed can falls through the opening 34 and the next can drops into the can receiving area 30. This provision allows a plurality of cans to be placed in the automatic can smasher at one time. This save time by not having to wait and feed one can at a time.

In the basic embodiment of the automatic can smasher 10, the wiring is very simple. The switch 20 is placed in series with the motor 16 and an electric cord plugged into a standard wall outlet. A safety wiring harness is also available. This provides for interlock switches placed on lid 60 and on the cabinet door, if the automatic can smasher is mounted under a table top or counter. A safety switch can also be placed on the can receiving receptacle 62 to prevent insertion of hands into the can receiving area 30 during operation. In all the various configurations of the safety wiring harness all the switches are in series. If any of the switches are opened the automatic can smasher will not operate.

A housing, not shown, can also be provided for free standing or mounting over a trash receptacle. The automatic can smasher 10 would be mounted inside the housing with an opening over the can receiving area. Another opening would be provided on the bottom for the smashed cans to fall through. As stated in the objectives, the design of the automatic can smasher of this invention make it very versatile. It can be mounted or positioned in many locations without modifications. The only differences is how it is mounted.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A automatic can smasher comprising:

a frame assembly having a pair of channels defining bottom and sides of a can receiving area for receiving and supporting a can to be smashed, said channels being in a parallel spaced relationship with a first end, second end, top and bottom, a motor mount attached to a bottom of said frame assembly near said first end of said channels, said motor mount securing said first end of said channels of said frame assembly in a spaced relationship, a switch mounting plate attached to said second end of said frame assembly, said switch mounting plate securing and holding said second end of said channels of said frame assembly in a spaced relationship and defining a second end of said can receiving area, an opening through said channels in said frame assembly in front of said switch mounting plate and within said can receiving area, for allowing a smashed can to drop through said frame assembly, a switch mounted on said switch mounting plate with a lever of said switch extending through said switch mounting plate and over said opening in said frame assembly, said lever being operated by placement of a can into said can receiving area, a motor attached to said motor mount with a shaft of said motor extending between said channels of said frame assembly, said motor being activated by said switch, a rotating lever with a first end attached to and rotated by said shaft of said motor, a second end of said rotating lever having a pivot pin attached thereto, a reciprocating lever with a first end attached to said pivot pin on said rotating lever, and a plunger attached to a second end of said reciprocating lever and defining a first end of said can receiving area, said plunger being operated in a parallel movement along said top of said channels of said frame assembly, said plunger operating to compress and smash a can against said switch mounting plate, said can falls through said opening after being compressed by said plunger thereby clearing the can receiving area for another can.

2. The automatic can smasher as set forth in claim 1 in which said channels comprise two parallel angle iron pieces in a parallel spaced relation, one leg of each of said angle iron pieces facing inward to form a bottom of said can receiving area and each of said angle irons having a second leg extending upwards to define sides of said can receiving area, said opening of said frame assembly being made in the inward facing legs near said switch mounting plate.

3. The automatic can smasher as set forth in claim 1 in which said switch comprises a micro switch with a lever of said micro switch extending through an aperture on said switch mounting plate, said lever extending over said opening in said frame assembly such that a can placed in the can receiving area operates said lever.

4. The automatic can smasher as set forth in claim 1 further comprising a next can slide bar attached to said reciprocating lever, said next can slide bar closing off said can receiving area as said plunger operates to smash a can for preventing another can from falling into said can receiving area and preventing another can from jamming the reciprocating action of said piston.

5. The automatic can smasher as set forth in claim 1 further comprising a can receiving receptacle attached to said frame assembly over said can receiving area, said can receiving receptacle for receiving and feeding a plurality of cans into said automatic can smasher one after another.

6. The automatic can smasher as set forth in claim 1 further comprising a table mounting assembly, said table mounting assembly attached to said frame assembly for securing said automatic can smasher on an underside of a table top, said table top having an opening over said can receiving area for feeding cans into said automatic can smasher.

7. The automatic can smasher as set forth in claim 6 further comprising a sliding lid on said table top to close and open said opening in said table top.

8. The automatic can smasher as set forth in claim 7 further comprising a safety switch to prevent said motor from operating when said lid is open.

9. The automatic can smasher as set forth in claim 1 in which said motor is an electric split phase gear motor.

10. The automatic can smasher as set forth in claim 1 further comprising a bag ring for attachment of a trash bag for the collection of smashed cans, said bag ring attached to said bottom of said channels under said opening.

11. A automatic can smasher comprising:

a frame assembly consisting of two parallel angle iron pieces in a parallel spaced relationship, one leg of each of said angle iron pieces facing inward to form a bottom of a can receiving area and each of said angle iron pieces having a second leg extending upwards to define sides of said can receiving area, having a pair of channels defining bottom and sides of a can receiving area for receiving and supporting a can to be smashed, said channels being in a parallel spaced relationship with a first end, second end, top and bottom, a motor mount attached to a bottom of said frame assembly near said first end of said channels, said motor mount securing said first end of said channels of said frame assembly in a spaced relationship, a switch mounting plate attached to said second end of said frame assembly, said switch mounting plate securing and holding said second end of said channels of said frame assembly in a spaced relationship and defining a second end of said can receiving area, an opening through said inward facing legs of said angle iron pieces in front of said switch mounting plate and within said can receiving area, for allowing a smashed can to drop through said frame assembly, a switch mounted on said switch mounting plate, said switch being a micro switch with a lever of said micro switch extending through an aperture on said switch mounting plate and over said opening in said frame assembly, said lever being operated by placement of a can into said can receiving area, a motor attached to said motor mount with a shaft of said motor extending between said channels of said frame assembly, said motor being activated by said switch, a rotating lever with a first end attached to and rotated by said shaft of said motor, a second end of said rotating lever having a pivot pin attached thereto, a reciprocating lever with a first end attached to said pivot pin on said rotating lever, a plunger attached to a second end of said reciprocating lever and defining a first end of said can receiving area, said plunger being operated in a parallel movement along said top of said channels of said frame assembly, said plunger operating to compress and smash a can against said switch mounting plate, said can falls through said opening after being compressed by said plunger thereby clearing the can receiving area for another can, a next can slide bar attached to said reciprocating lever, said next can slide bar closing off said can receiving area as said plunger operates to smash a can for preventing another can from falling into said can receiving area and preventing another can from jamming the reciprocating action of said piston, and a bag ring for attachment of a trash bag for collection of smashed cans, said bag ring attached to said bottom of said channels under said opening.

12. The automatic can smasher as set forth in claim 11 further comprising a can receiving receptacle attached to said frame assembly over said can receiving area, said can receiving receptacle for receiving and feeding a plurality of cans one after another into said can receiving area on said automatic can smasher.

13. The automatic can smasher as set forth in claim 11 in which said motor is an electric split phase gear motor.

14. An automatic can smasher in which comprises:

a frame assembly having a can receiving area defined by a pair of channels held in a parallel spaced relationship, said can receiving area containing an opening through a bottom of one end of said can receiving area, a motor attached to an underside of said frame assembly on an end opposite of said opening, said motor having a shaft extending upwards between said channels, plunger assembly comprising a rotatable arm attached to said shaft of said motor, a reciprocating arm pivotally attached to an outward end of said rotatable arm and a plunger plate attached to an end of said reciprocating arm, said plunger assembly attached to said frame assembly over said motor, said plunger assembly operating said plunger plate in a reciprocating motion along said channels to compress cans placed in said can receiving area, a switch plate attached to an end of said can receiving area opposite to said plunger assembly, said switch plate defining an end of said can receiving area, said switch plate having an aperture therethrough, a switch attached to said switch plate with a lever of said switch extending through said aperture of said switch plate, a can placed within said can receiving area operates said lever, said switch being electrically connected to said motor to activate the motor when said switch is closed, as the smashed can falls through said opening said lever is released to open said switch and deactivated said motor.

* * * * *